United States Patent [19]

Danzik

[11] 4,185,961

[45] Jan. 29, 1980

[54] POLYPYRROLIDONE FIBER TREATMENT

[75] Inventor: Mitchell Danzik, Pinole, Calif.

[73] Assignee: Chevron Research Company, San Francisco, Calif.

[21] Appl. No.: 851,081

[22] Filed: Nov. 14, 1977

[51] Int. Cl.[2] ..... D06M 13/34

[52] U.S. Cl. ..... 8/115.5; 8/185; 8/186

[58] Field of Search ..... 8/115.5

[56] References Cited

U.S. PATENT DOCUMENTS

| | | | |
|---|---|---|---|
| 2,734,004 | 2/1956 | Robinson | 428/260 |
| 3,318,658 | 5/1967 | Leahy et al. | 8/115.5 |
| 3,721,652 | 3/1973 | Barnes | 260/78 P |

OTHER PUBLICATIONS

Moncrieff, R. W., "Man-Made Fibres" (John Wiley, 1975) pp. 682–683.

Mark, H., Wooding, N. S., and Atlas, S. M., "Chemical Aftertreatment of Textiles," 1971, Wiley, pp. 337–340.

Marsh, J. T., "*Crease Resisting Fabrics,* " (Reinhold), 1962, pp. 64–67 and 74–75.

*Primary Examiner*—A. Lionel Clingman

*Attorney, Agent, or Firm*—J. A. Buchanan, Jr.; D. A. Newell; T. G. DeJonghe

[57] ABSTRACT

A method for reducing the fibrillation of polypyrrolidone fibers which comprises contacting the fibers with an aqueous solution containing dimethyloldihydroxyethyleneurea and an acidic catalyst.

9 Claims, No Drawings

POLYPYRROLIDONE FIBER TREATMENT

BACKGROUND OF THE INVENTION

The present invention relates to the treatment of polypyrrolidone fibers with a certain chemical to reduce fibrillation.

Preparation of polypyrrolidone fibers is known in the art, see for example Barnes U.S. Pat. No. 3,721,652.

Polypyrrolidone fibers have a number of advantages, but one disadvantage they suffer from is fibrillation, that is, the fibers as such and the fibers when in the form of yarns and fabrics develope small fibrils when subjected to washing. These fibrils are hair-like whiskers still attached to the main fiber at one end.

Fibrillation is a phenomenon induced in fibrous materials by the application of stress, and is characterized by the development of hair-like shoots to the parent filament or fiber of longitudinal sections of material which are usually referred to as "fibrils". The dimensions of the fibrils are small compared to those of the original filament fiber. The formation of the small attached fibrils is referred to as fiber breakdown or fibrillation and can readily be observed under the microscope, where the presence of fibrils on the main fiber strand may be seen. In undyed fabrics the presence of fibrils may not be apparent to casual inspection but it is evidenced by dulling of the finish, change in hand, and can be seen on microscopic examination. Dyed fibers of melt extruded and oriented polypyrrolidone readily display the effects of fibrillation which causes a loss of color intensity. Both the change in hand and the loss of color intensity are undesirable in commercial articles.

The effects of fibrillation become evident on repeated laundering and tumble-drying and substantial absence of fibrillation is thus necessary for good launderability of a fabric.

U.S. Pat. No. 3,318,658 is concerned with improving the resistance of polypyrrolidone fibers to fibrillation. According to U.S. Pat. No. 3,318,658, polypyrrolidone fibers are subjected to the action of formaldehyde in the presence of an acidic methylolation catalyst under nonsolubilizing conditions, and then water is removed to effect cross-linking.

U.S. Pat. No. 3,318,658 states in column 3, line 59, that the term "formaldehyde" is used therein "... to encompass aldehydic agents such as formaldehyde and sources thereof, e.g., paraformaldehyde, to methylol urea, dimethylol ethylene urea, dimethyl formal, saligenin, formalin, hexamethylene tetramine, and the like."

With respect to the methylolation catalyst, the '658 patent states that methylolation catalysts which are useful for the process "... are those reagents or combination of reagents which produce aqueous solutions of pH values ranging from pH 1 to pH 5. Specific examples of such agents include dilute aqueous solutions of strong acids, water-soluble weak acids and salts of acids with weaker bases. Such substances include 0.01 N aqueous hydrochloric acid, ammonium chloride, zinc chloride, sodium bisulfite, ammonium sulfate, oxalic acid and very dilute formic acid. Glycolic and lactic acid are also suitable as catalysts but have the disadvantage of plasticizing the fibers and thus degrading their mechanical properties."

One disadvantage of using formaldehyde or formaldehydeforming materials for reduction of polypyrrolidone fiber fibrillation is that a formaldehyde odor frequently remains after curing the treated fibers or fabrics.

The present invention is particularly concerned with the use of dimethyloldihydroxyethyleneurea, which has also been used to give cotton fabrics a permanent-press characteristic.

SUMMARY OF THE INVENTION

According to the present invention, a method is provided for reducing the fibrillation of polypyrrolidone fibers which comprises contacting the fibers with an aqueous solution containing dimethyloldihydroxyethyleneurea (DMDHEU) and an acidic catalyst.

Among other factors, the present invention is based on my finding that DMDHEU is exceptionally effective at reducing fibrillation of polypyrrolidone fabrics and that the DMDHEU treatment does not result in a formaldehyde odor upon curing the treated fibers at elevated temperature or storage in a closed container after curing the treated fibers or fabric.

The term polypyrrolidone is used herein to refer to the polymerized product of 2-pyrrolidone. Also, the term is used to include polymers which consist predominantly of polymerized 2-pyrrolidone but which may contain a minor amount, such as 0.1 up to 20 or 30 weight percent, of a polymer such as a polyester or another polyamide such as nylon 6 or nylon 6,6. These compositions may be either mixtures of polymers or true copolymers.

The structure of DMDHEU may be illustrated as follows:

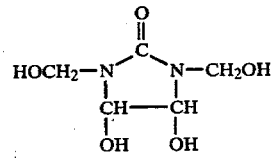

The fiber or fabric treated by the process of the present invention will usually contain from 1 to 25, preferably 5 to 15 percent by weight of incorporated DMDHEU.

Preferred amounts of DMDHEU used in the aqueous treating solution of the process of the present invention are 1 to 50 weight percent, more preferably 5 to 20 weight percent, and most preferably about 10 weight percent DMDHEU.

Various acidic catalysts can be used in the aqueous solution such as ammonium chloride, magnesium chloride, and zinc nitrate. However, ammonium chloride is preferred. Preferred concentrations of ammonium chloride acidic catalysts in the treating solutions are between 0.2 to 10 weight percent, more preferably between 0.5 and 5 weight percent. Most preferably, the amount of ammonium chloride is about 2 weight percent. Preferably the weight ratio of DMDHEU to ammonium chloride is in the range of 2:1 to 10:1, preferably 5:1.

The contacting of the polypyrrolidone fibers with the aqueous solution containing the DMDHEU and the preferred ammonium chloride acidic catalyst can be carried out with the polypyrrolidone fibers either in fiber form per se or with the fibers in the form of a fabric. Preferably, the contacting with the DMDHEU solution is carried out with the fibers in the form of a fabric.

Preferred temperatures for the contacting of the fibers with the DMDHEU solution are between 5° and 50° C. or preferably about room temperature, for example, between 20° and 30° C. The contacting time or soaking time with the aqueous DMDHEU solution is preferably at least 1 minute, usually between 3 and 60 minutes, and more preferably between 4 and 30 minutes.

After the soaking period, the fibers or fabric is removed from the soaking solution and excess solution is removed, for example, by pressing it off the fiber or fabric.

Then the treated polypyrrolidone fibers or fabric is dried, preferably at 20° to 70° C., more preferably at 25° to 60° C. Typical drying time is from 10 to 60 minutes.

After drying, the fibers or fabric is cured, preferably at a temperature of between 50° and 150° C., more preferably between 60° and 140° C. Typical curing time is between 5 and 60 minutes, preferably 10 to 20 minutes.

One of the advantages I have found from the use of DMDHEU, is that the fabric need not be immediately cured after the DMDHEU treatment. Instead, it may be stored and cured at a later time. Such cannot be done with the formaldehyde techniques because the formaldehyde is lost due to its volatility. When using the DMDHEU treatment of the present invention, the trated fabric may be stored after drying but before curing. After a storage period, the fabric may be cut to form garments and then the garments cured effectuate or complete the process.

Cross-linking is belived to be the chemical mechanism by which fibrillation of the polypyrrolidone fibers is reduced through the method of the present invention.

According to another embodiment of the present invention, an improved polypyrrolidone fabric is provided which is produced by a process in accordance with the present invention.

I have found that using a fabric softener in combination with the DMDHEU solution enhances the quality of the fabric by making the "hand" of the resulting fabric less harsh. The "hand" or "handle" of fabrics is basically a subjective test. E. R. Schwarz, "Textile Testing", in H. R. Mauersberger, ed., J. M. Matthews' *Textile Fibers,* 5th ed., John Wiley & Sons, Inc., New York, 1947, defines hand as the "feel" of the material and qualitatively includes such terms as stiffnes (or limpness), hardness (or softness), and roughness (or smoothness). Similarly, R. Hoffman and L. Best, Textile Res. J. 21, 66 (1951), define hand as the impression which arises when fabrics are touched, squeezed, rubbed, or otherwise handled. Suitable softeners include American Cyanamid's "Cyanatex Softener CAT", which is a cationic material. The American Cyanamid softener is described in American Cyanamid's Technical Sales Bulletin No. 217. Preferably the Cyanatex softener is used in combination with a surfactant such as American Cyanamid's "Deceresol Surfactant NI", which is described in American Cyanamid's Technical Sales Bulletin No. 182 as a nonionic surface active agent. An alternate softener which may be used is American Cyanamid's "Aerotex Water-Repellant 96" which is described in American Cyanamid's Bulletin No. 258 as a cationic material.

EXAMPLES

A knitted nylon 4 fabric sample was immersed in a 37% formaldehyde solution containing 0.5% ammonium chloride for 10 minutes. It was pressed between paper towels to obtain a 50% wet weight gain, then dried at 50° C. for 30 minutes. The sample was cured immediately or stored for a specified period of time before being cured. Curing was accomplished by heating at 120° C. for 15 minutes.

The procedure for DMDHEU treatment was similar. About 2% ammonium chloride was used as the catalyst and the formulation also contained a softener and a surfactant.

The effectiveness of the reagent used was determined by its ability to inhibit fibrillation after extended washing. As shown below in Table I, DMDHEU was effective after post curing while formaldehyde was not.

TABLE I

| Reagent | Curing | Fibrillation After Extended Washing[1] |
|---|---|---|
| Formaldehyde | Immediate | Trace |
| Formaldehyde | After 1 week[2] | Moderate to Heavy[3] |
| DMDHEU | Immediate | Trace to light |
| DMDHEU | After 4 weeks | Trace to light |

[1]After 50 wash cycles (15 minutes/cycle) in a Terg-O-Tometer.
[2]At room temperature.
[3]After 30 wash cycles.

What is claimed is:

1. A method for reducing the fibrillation of polypyrrolidone fibers which comprises contacting the fibers with an aqueous solution containing dimethyloldihydroxyethyleneurea and an acidic catalyst.

2. A method in accordance with claim 1 wherein the acidic catalyst is ammonium chloride and the contacting is carried out at a temperature between 5° and 50° C.

3. A method in accordance with claim 2 wherein the temperature is between 20° and 30° C.

4. A method in accordance with claim 3 wherein the amount of dimethyloldihydroxyethyleneurea is between 5 and 20 weight percent and the amount of ammoniun chloride is between 0.2 and 10 weight percent in the aqueous solution based on the total weight of the aqueous solution.

5. A method in accordance with claim 4 wherein after the fibers are contacted with dimethyloldihydroxyethyleneurea, they are dried at 25° to 60° C. and then cured at 60° to 140° C.

6. A method in accordance with claim 5 wherein the contacting is carried out in the presence of a fabric softener.

7. A polypyrrolidone fabric produced by a method for reducing fibrillation which comprises contacting the fibers which make up the fabric with an aqueous solution containing dimethyloldihydroxyethyleneurea in the presence of an acidic catalyst.

8. A polypyrrolidone fabric in accordance with claim 7 produced by a method which comprises contacting the fibers with an aqueous solution containing between said 5 and 20 weight percent dimethyloldihydroxyethyleneurea and between 0.2 and 10 percent ammonium chloride.

9. A polypyrrolidone fabric in accordance with claim 8 wherein the contacting with the solution is carried out at 25° to 60° C. and the curing is carried out at 60° to 140° C.

* * * * *